US010731958B1

(12) United States Patent
Genson

(10) Patent No.: US 10,731,958 B1
(45) Date of Patent: Aug. 4, 2020

(54) MONOLITHIC FRAGMENTATION CASING WITH TUNNEL PATTERN

(71) Applicant: Department of the Navy, Indian Head, MD (US)

(72) Inventor: Kevin Genson, Waldorf, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/530,020

(22) Filed: Nov. 22, 2016

(51) Int. Cl.
*F42B 12/22* (2006.01)
*F42B 33/00* (2006.01)

(52) U.S. Cl.
CPC ..... *F42B 12/22* (2013.01); *F42B 33/00* (2013.01)

(58) Field of Classification Search
CPC ..... F42B 12/22; F42B 12/24; F42B 12/32; F42B 33/00
See application file for complete search history.

(56) References Cited

U.S. PATENT DOCUMENTS

| | | | | | |
|---|---|---|---|---|---|
| 189,358 | A * | 4/1877 | Hotchkiss | F42B 12/32 | 102/494 |
| 4,305,333 | A * | 12/1981 | Altenau | F42B 12/14 | 102/306 |
| 4,312,274 | A * | 1/1982 | Zernow | F42B 12/22 | 102/493 |
| 5,126,105 | A * | 6/1992 | Runkle | B22F 3/04 | 419/30 |
| 6,484,642 | B1 * | 11/2002 | Kuhns | F42B 12/24 | 102/493 |
| 7,093,542 | B2 * | 8/2006 | Gousman | F42B 12/22 | 102/493 |
| 9,738,948 | B2 * | 8/2017 | Gwaltney | C21D 9/16 | |
| 2016/0178336 | A1 * | 6/2016 | Jennett | F42B 12/207 | 102/506 |

FOREIGN PATENT DOCUMENTS

| | | | | |
|---|---|---|---|---|
| DE | 4025097 | A1 * | 2/1992 | F42B 12/32 |
| DE | 102014014332 | B3 * | 3/2016 | F42B 1/02 |
| FR | 2590823 | A1 * | 6/1987 | B23K 26/1435 |

* cited by examiner

*Primary Examiner* — Benjamin P Lee
(74) *Attorney, Agent, or Firm* — Fredric J. Zimmerman

(57) ABSTRACT

A fragmentation casing is defined by a monolithic tube having a solid radial wall and a pattern of tunnels defined in the solid radial wall. The tunnels may be filled with air, a powder that is a powdered form of the material used to make the solid radial wall, or a solid material that is the same as the solid radial wall but whose mechanical attributes differ from those of the solid radial wall.

13 Claims, 3 Drawing Sheets

MONOLITHIC FRAGMENTATION CASING WITH TUNNEL PATTERN

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to fragmentation casings, and more particularly to a monolithic fragmentation casing that incorporates a pattern of tunnels within the casing.

BACKGROUND OF THE INVENTION

Fragmentation casings are used in warheads for bombs, missiles, and related devices. Typically, a fragmentation casing relies on controlled fragmentation of a metal body when subjected to rapid pressurization experienced from a detonating explosive fill. Conventional methods for fabricating fragmentation casings rely on either preformed fragments in a matrix or the use of scoring or notches to induce shear in specific orientations. These methods are limited in terms of their performance (e.g., caused by uneven distribution of fragments, parasitic mass, poor resistance to acceleration, poor fragment velocity, etc.) and manufacturing complexities.

SUMMARY OF THE INVENTION

Accordingly, it is an object of the present invention to provide a fragmentation casing and method for making same.

Another object of the present invention is to provide a monolithic fragmentation casing that defines fragment distribution.

Other objects and advantages of the present invention will become more obvious hereinafter in the specification and drawings.

In accordance with the present invention, a fragmentation casing including a monolithic tube having a solid radial wall and a pattern of tunnels defined in the solid radial wall. The tunnels may be filled with air, a powder that is a powdered form of the material used to make the solid radial wall, or a solid form of the material used to make the solid radial wall but whose hardness differs from that of the solid radial wall.

BRIEF DESCRIPTION OF THE DRAWINGS

Other objects, features and advantages of the present invention will become apparent upon reference to the following description of the exemplary embodiments and to the drawings, where corresponding reference characters indicate corresponding parts throughout the several views of the drawings and wherein.

DETAILED DESCRIPTION OF THE INVENTION

Figure 1:
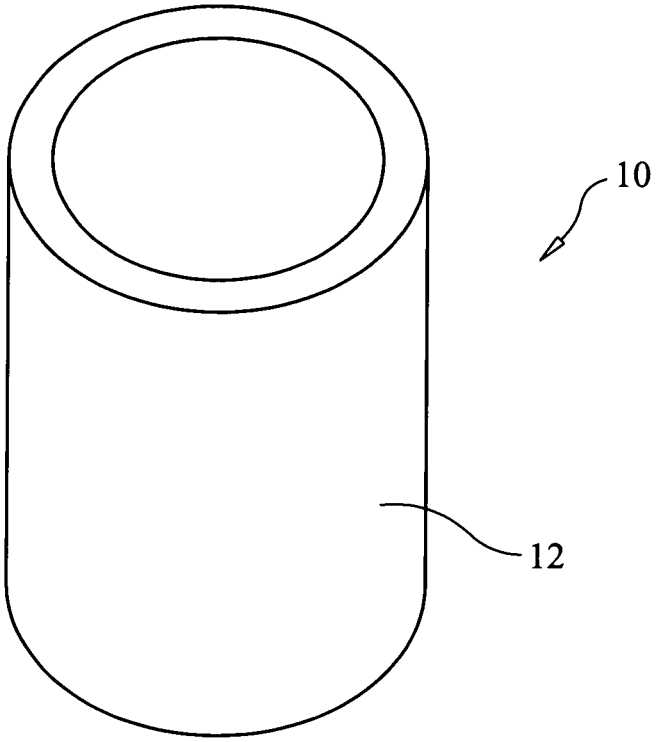
FIG. 1 is a perspective view of a monolithic fragmentation casing in accordance with an exemplary embodiment of the present invention.

Referring now to the drawings, simultaneous reference will be made to FIGS. 1-2 where a monolithic fragmentation casing in accordance with an exemplary embodiment of the present invention is shown and is referenced generally by numeral 10. In the illustrated embodiment, fragmentation casing 10 is a hollow tubular structure that is open at either axial end thereof. Fragmentation casing 10 may be incorporated into a fragmentation warhead where the hollow region of casing 10 defines a volume that would generally be filled with explosive materials (not shown) as would be understood in the art. The choice of explosive material(s) and the configuration or arrangement thereof within the volume defined by casing 10 is not a limitation of the present invention.

In general, casing 10 is a monolithic structure that has a pattern of tunnels integrally formed in the solid radial wall of casing 10. As will be explained further below, the tunnels are arranged in a pattern to facilitate a controlled pattern of fragments when casing 10 is exploded by explosive materials (not shown) contained within the volume defined by casing 10. The pattern of tunnels may be a contiguous pattern (e.g., herringbone, interlocking weave, etc.). The pattern of tunnels also may be defined by a pattern of discontinuous tunnels (e.g., individual vertical, horizontal or angled tunnels, individual spherical or other geometric shapes arrayed in a pattern throughout the solid radial wall, etc.). Each tunnel may be filled with air, a powder form of the material used to make the solid radial wall of casing 10, or a solid form of the material used to make the solid radial wall of casing 10 but whose hardness differs (i.e., harder or softer) from that of the solid radial wall of casing 10.

Figure 2:
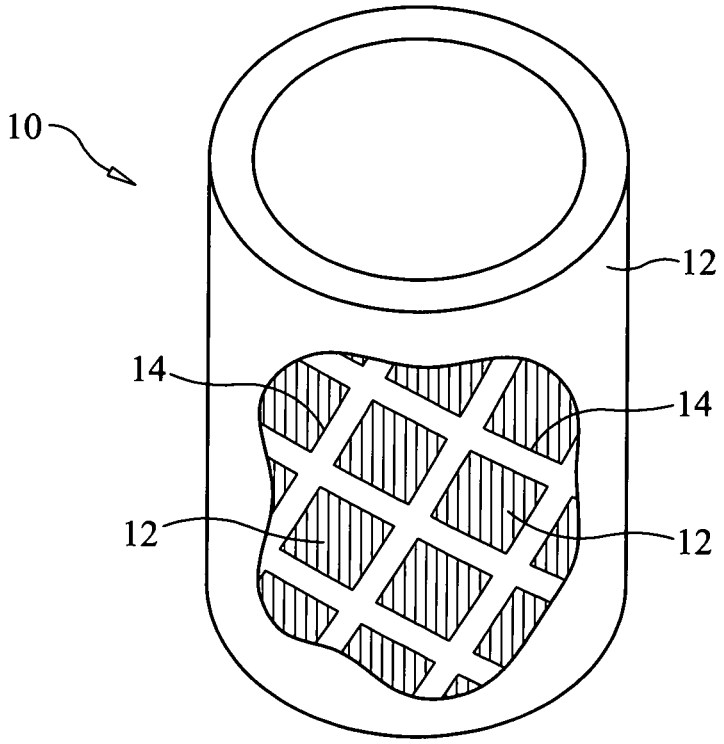
FIG. 2 is perspective view of the monolithic fragmentation casing partially cut away to reveal a cross-section of the casing illustrating a tunnel pattern filled with air in accordance with an exemplary embodiment of the present invention.
Figure 3:
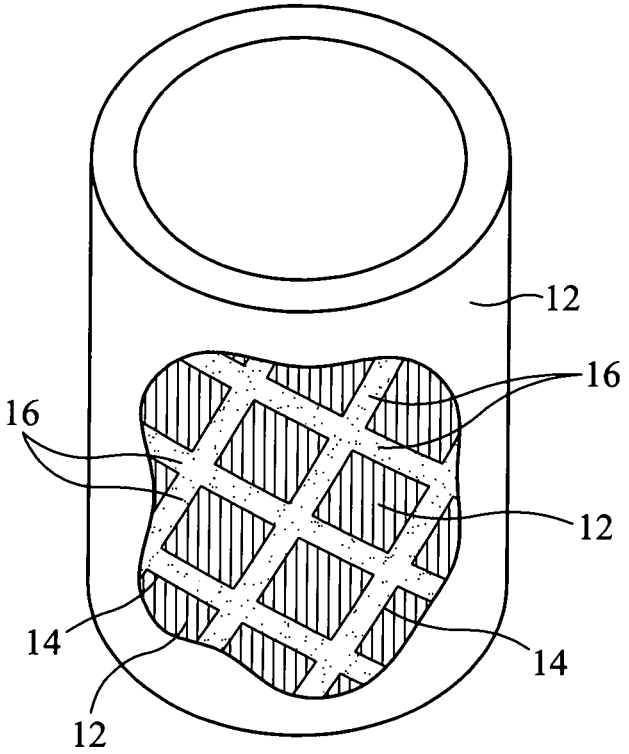
FIG. 3 is perspective view of a monolithic fragmentation casing partially cut away to reveal cross-section of the casing illustrating a tunnel pattern filled with powder in accordance with another exemplary embodiment of the present invention.

In FIG. 2, casing 10 is partially cut away to reveal a cross-section of the casing's solid radial wall 12 and a pattern of tunnels 14 defined within solid radial wall 12. Tunnels 14 are contiguous with one another throughout solid wall 12 and are filled with air. However, the present invention is not limited to tunnels filled with air. For example, in FIG. 3, the same contiguous pattern of tunnels 14 shown in FIG. 2 is filled with a powder material 16. As mentioned above, powder material 16 is a powdered form the material used to make solid radial wall 12.

Figure 4:
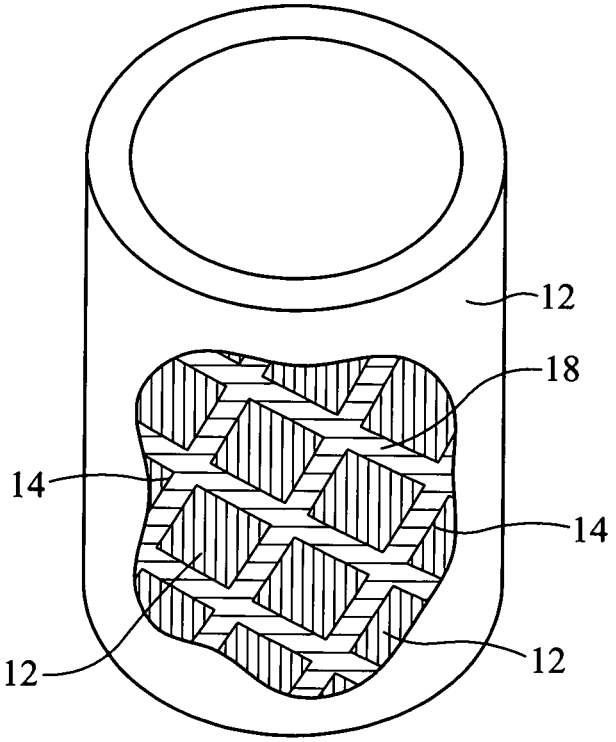
FIG. 4 is perspective view of a monolithic fragmentation casing partially cut away to reveal cross-section of the casing illustrating a tunnel pattern filled with a disparate-attribute solid material in accordance with another exemplary embodiment of the present invention.
Figure 5:
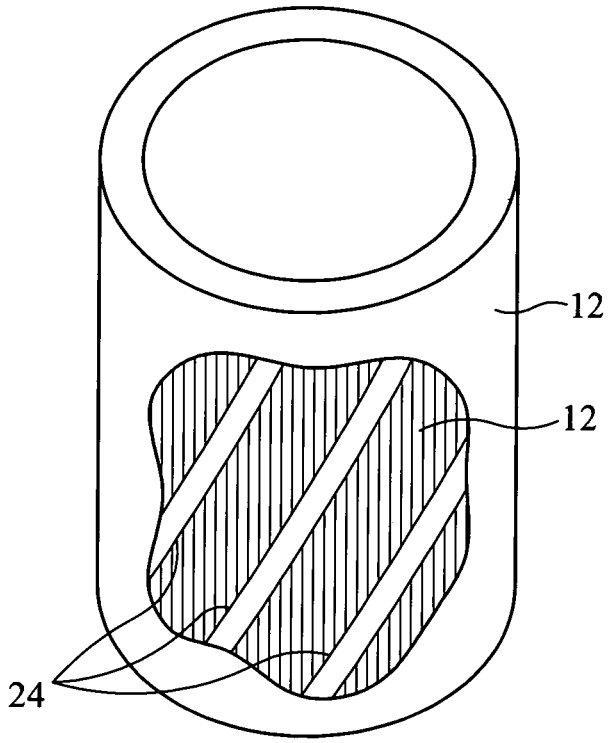
FIG. 5 is perspective view of a monolithic fragmentation casing partially cut away to reveal a cross-section of the casing illustrating a pattern of discontinuous tunnels in accordance with still another embodiment of the present invention.

In FIG. 4, the same contiguous pattern of tunnels 14 shown in FIG. 2 is filled with a solid material 18 that is the same material used to make solid radial wall 12. However, in this embodiment, the material attributes of solid material 18 (i.e., strength, grain structure, and hardness) are different than that of the surrounding solid radial wall 12. In general, the hardness of solid material 18 will be different (i.e., harder or softer) than that of solid radial wall 12 that surrounds tunnels 14. This difference may facilitate and/or control the fragmentation of casing 10.

Still further, the present invention is not limited to a contiguous pattern of tunnels in the solid radial wall of the casing. For example, in FIG. 4, a discontinuous pattern of tunnels 24 (e.g, a number of individual tunnels, each of which is angled with respect to the longitudinal axis of the casing) are defined in solid radial wall 12. Tunnels 24 may be filled with air, a powder material that is a powdered form of the material used to make solid radial wall 12, or a solid form of the material used to make solid radial wall 12 but whose hardness differs (i.e., harder or softer) from that of solid radial wall 12.

Fabrication of each embodiment of casing 10 may be accomplished using an additive manufacturing process known as powder bed fusion. Casing 10 may be made from a metal, a plastic material, or a ceramic material. Suitable metals may include aluminum, titanium, steel, stainless steel, Inconel, tungsten, copper, brass, zirconium, magnesium, tantalum, and alloys thereof. However, it is to be understood that the present invention is not limited to the use of these metals as any metal, plastic, etc., that lends itself to use in a powder bed fusion process may be used. For example, suitable plastics include a variety of thermoplastic polymer materials to include, but not limited to, nylon, ABS, PVC, polycarbonates, ULTEM, HDEP, etc.

In a powder bed fusion process, a fusable material (e.g., metal, plastic, ceramic, etc.) is provided in a powdered state. In general, a powder bed fusion process causes an electromagnetic beam of radiation (e.g., laser beam, electron beam, etc.) to be directed towards the bed of fusable powder in accordance with a prescribed plan such that the fusable powder fuses/solidifies into a solid state to define a solid part. The unfused powder is then discarded as the finished solid part is removed from the powder bed. When casing 10 is fabricated using a powder bed fusion process in accordance with the present invention, the contiguous or discontinuous tunnels formed in the casing's solid radial wall may be air-filled or remain completely filled with unfused, fusable powder material. The beam of radiation also may be adjusted such that the fusable powder material is fused to a solid form thereof whose properties (e.g., grain structure, strength, and hardness) are different than those of the surrounding solid radial wall. In each case, casing 10 is a monolithic structure made completely from the same material as the solid radial wall is the solid state of the fusable powder material, while tunnels defined in the solid radial wall may remain filled with the unfused powder material used to make the solid radial wall.

Casing 10 may be incorporated into a fragmenting warhead by disposing explosive fill material(s) (not shown) within the tubular volume defined by solid radial wall 12. The choice and construction of the explosive fill material(s) are not limitations of the present invention. Retention of the unfused powder material within the tunnels serves to provide structural integrity of the tunnels, provide localized blast effects from movement of powder material upon detonation of the casing, and may also provide incendiary effects if the unfused powder material is reactive.

The advantages of the present invention are numerous. The monolithic fragmentation casing has structural integrity, while the casing's tunnels control fragmentation and the tunnel-contained material may provide enhanced localized shock protection and potentially incendiary effects. The single manufacturing process for making the casing from a single material avoids manufacturing defects and costs that are inherent to conventional manufactured casings made from multiple materials.

Although the invention has been described relative to a specific exemplary embodiment thereof, there are numerous variations and modifications that will be readily apparent to those skilled in the art in light of the above teachings. It is therefore to be understood that, within the scope of the appended claims, the invention may be practiced other than as specifically described.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should be at least construed in light of the number of significant digits and by applying ordinary rounding.

What is claimed is:

1. A fragmentation casing, comprising:

a monolithic tube including a solid radial wall including a pattern of regions of different material properties being integrally formed in said solid radial wall so as being attached to and part of said solid radial wall, wherein the solid radial wall is comprised of a material, wherein the regions are part of the material, wherein said material of the regions is identical to the material used to make said solid radial wall, wherein the regions are a plurality of solid, fused, non-powdered regions, wherein the plurality of the solid, fused, non-powdered regions have variations in their material properties, and wherein said material properties include an internal hardness, porosity, and grain structure.

2. The fragmentation casing as in claim 1, wherein said monolithic tube is open at axial ends thereof.

3. The fragmentation casing as in claim 1, wherein said regions are contiguous with one another throughout said solid radial wall.

4. The fragmentation casing as in claim 1, wherein said regions include at least one of a continuous pattern of regions and a discontinuous pattern of regions throughout said solid radial wall.

5. The fragmentation casing as in claim 1, wherein the monolithic tube is an open-ended and hollow monolithic tube defined by the solid radial wall including the plurality of solid, fused, non-powdered regions, which are a pattern of regions of a same solid material but with different material properties integrally formed in the solid radial wall.

6. The fragmentation casing according to claim 1, wherein the solid radial wall and the plurality of regions are materially identical.

7. The fragmentation casing according to claim 1, wherein the plurality of regions are comprised of fused, solid-state material, and chemically identical.

8. The fragmentation casing according to claim 1, wherein the plurality of regions are internally formed in the solid radial wall.

9. A method of making a fragmentation casing, comprising:

providing a bed of fusable powder; and directing a beam of electromagnetic radiation at said bed for causing a first portion of said fusable powder to solidify for defining an open-ended and hollow monolithic tube being defined by a radial wall of a solid material including a pattern of first regions being defined in said radial wall, wherein a second portion of said fusable powder, which is not solidified by said beam, remains in a powder form and comprises a plurality of second regions.

10. The method according to claim 9, said fusable powder comprises one of a metal powder, a plastic powder, and a ceramic powder.

11. The method according to claim 10, wherein said metal powder comprises a metal selected from a group consisting of aluminum, titanium, steel, stainless steel, Inconel, tungsten, copper, brass, zirconium, magnesium, tantalum, and alloys thereof.

12. The method according to claim 10, wherein said plastic powder comprises a thermoplastic plastic material.

13. A method of making a fragmentation casing, comprising:

providing a bed of fusable powder, wherein the fusable powder includes a first portion and a second portion; and directing a beam of electromagnetic radiation at said bed for causing the first portion of said fusable powder to solidify for defining an open-ended and hollow monolithic tube being defined by a radial wall of a solid material including a pattern of first regions being defined in said radial wall, directing the beam at said bed for causing the second portion of the fusable powder to solidify being defined by the solid material including a pattern of second regions, wherein the second portion of said fusable powder is solidified by said beam, and wherein the first regions and the second regions comprise a plurality of regions.

* * * * *